US007000795B2

(12) United States Patent
Serden

(10) Patent No.: US 7,000,795 B2
(45) Date of Patent: Feb. 21, 2006

(54) CONTAINER

(75) Inventor: Andreas Serden, Meersburg (DE)

(73) Assignee: Dornier GmbH, Friedrichshafen (DE)

( * ) Notice: Subject to any disclaimer, the term of this patent is extended or adjusted under 35 U.S.C. 154(b) by 230 days.

(21) Appl. No.: 10/197,501

(22) Filed: Jul. 18, 2002

(65) Prior Publication Data

US 2003/0024928 A1 Feb. 6, 2003

(30) Foreign Application Priority Data

Jul. 24, 2001 (DE) ..... 101 35 226

(51) Int. Cl.
*B65D 21/02* (2006.01)

(52) U.S. Cl. ..... 220/1.5; 220/8

(58) Field of Classification Search ..... 220/8, 220/1.5, 4.28, 4.31, 4.32, 23.83, 23.86, 666, 220/23.2, 23.8, 720; 52/67, 68, 69
See application file for complete search history.

(56) References Cited

U.S. PATENT DOCUMENTS 2,744,781 A * 5/1956 Black ..... 296/21
3,200,545 A * 8/1965 Bunge ..... 52/66
3,381,421 A * 5/1968 Sicklesteel ..... 296/26.11
4,689,924 A * 9/1987 Jurgensen ..... 52/67
4,912,892 A 4/1990 Jurgensen
5,291,701 A 3/1994 Delacollette et al.
5,732,839 A 3/1998 Schimmang et al.

FOREIGN PATENT DOCUMENTS

| | | |
|---|---|---|
| DE | 9216314.9 | 3/1993 |
| DE | 4429927 | 11/1995 |
| EP | 0682156 | 11/1995 |
| EP | 0760040 | 3/1997 |
| WO | 0069095 | 11/2000 |

* cited by examiner

*Primary Examiner*—Stephen Castellano
(74) *Attorney, Agent, or Firm*—Crowell & Moring LLP

(57) ABSTRACT

The invention relates to a container, in particular as a work room, with variable volume, having a basic container with a bottom wall and a roof wall, at least one expansion element, which can be moved out of the basic container and which exhibits a bottom wall, a side that is open in the direction of the basic container, as well as a front wall opposite the open side, and a device, with which the expansion element can be lowered and lifted. The basic container exhibits at least one hinged side wall and the expansion element is open at the top. In the moved-out state a roof wall of the expansion element is formed by the side wall that is opened up on hinges and belongs to the basic container.

16 Claims, 7 Drawing Sheets

CONTAINER

This application claims the priority of German Patent Document No. 101 35 226.3, filed Jul. 24, 2001, the disclosure of which is expressly incorporated by reference herein.

BACKGROUND AND SUMMARY OF THE INVENTION

The present invention relates to an expandable container, in particular as a work room.

An expandable container is disclosed, for example, in the German Patent Document DE-G 92 16 314.9. It comprises a basic container with hinged side walls and one or more expansion element(s), which can be moved out of the basic container. An expansion element comprises two side walls and a front wall. In the state in which the expansion element is moved out, two folded-out side walls of the basic container form the roof wall and bottom wall of an expansion element. The drawback with this design is the long seal that is necessary along the roof and bottom wall for sealing the container. This is a problem especially with the demand for ABC tightness.

A generic container is known from the European Patent Document EP 0 682 156 B1. It comprises a basic container as well as one or more expansion element(s), whose purpose is to expand the interior and which can be moved out of the basic container. The expansion elements exhibit the shape of a box and, with the exception of the open side in the direction of the basic container, are closed on all sides. There is also a lift unit, whose purpose is to achieve a flat bottom inside the entire container and with which the expansion elements can be lowered in such a manner that, after lowering, the bottom walls of the basic container and the expansion element are at the same height.

In the design with two expansion elements the dimensions of the two expansion elements have to be chosen in such a manner that the one expansion element can be slid into the other expansion element. The result is that the standing height is relatively short (approximately 190 cm), especially in the smaller of the two expansion elements.

Another drawback of this container is the circumstance that the area that is usually contaminated the most by the environmental influences, namely the roof wall of an expansion element, gets into the interior of the basic container when the expansion elements are retracted again. This factor is a problem especially when the container is used for medical purposes, for example, as an operating room.

Therefore, the object of the invention is to improve an expandable container of this class in such a manner that with the improved standing height the described problems arising from the contamination of its exterior surfaces are avoided.

The container of the present invention exhibits in particular the following advantages: improved standing height; simple sealing, short sealing lengths; and simplified decontamination.

Other objects, advantages and novel features of the present invention will become apparent from the following detailed description of the invention when considered in conjunction with the accompanying drawings

DETAILED DESCRIPTION OF THE DRAWINGS

Figure 1:
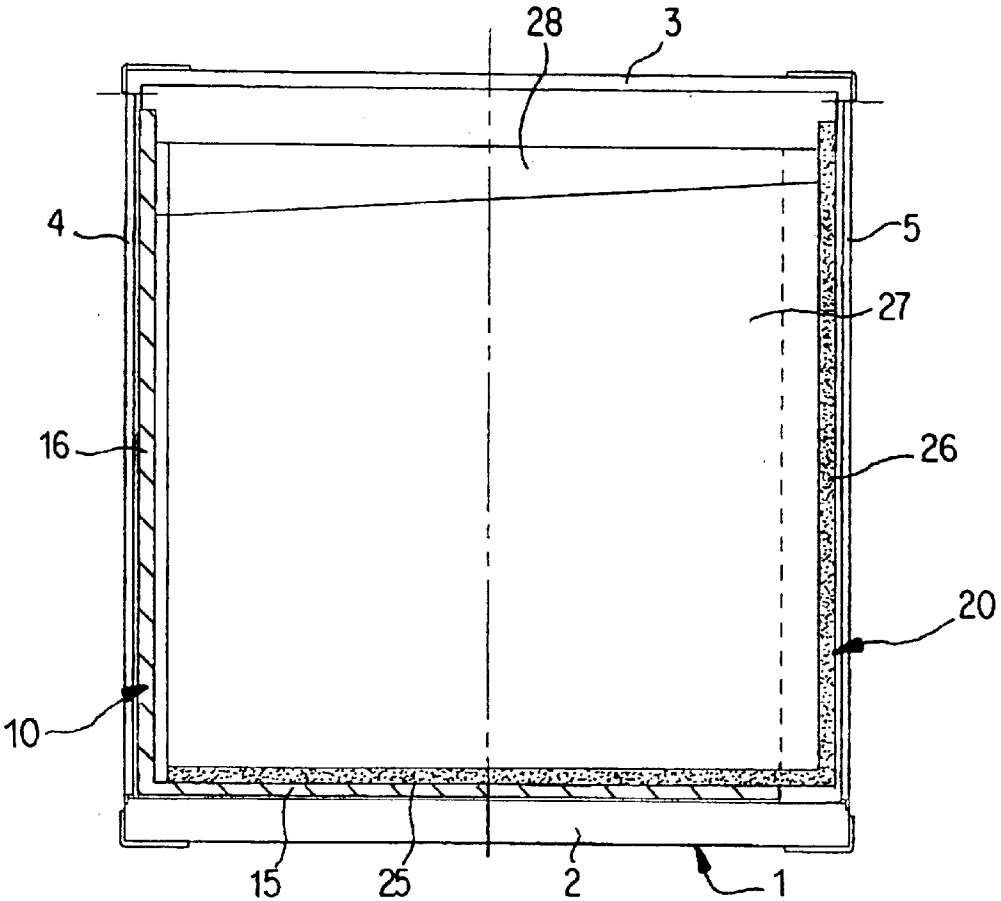
FIG. 1 is a vertical sectional view of an inventive container in the starting state with retracted expansion elements.

FIGS. 1 to 4 depict the individual steps for assembling an inventive container that can be expanded with two expansion elements. FIG. 1 depicts the starting state (transport state). The box-shaped basic container 1 includes two expansion elements 10, 20. At the same time the expansion element 20 is slid into the somewhat larger expansion element 10 (with respect to length and height, see also FIG. 6). One can recognize the respective bottom wall 15, 25 and front wall 16, 26 of the two expansion elements 10, 20 as well as a side wall 27 of the internal expansion element 20. In the illustration, the height of the front wall 16, 26 of an expansion element is chosen somewhat higher than the height of the related side wall 27. The basic container 1 exhibits a bottom wall 2, a roof wall 3 and two side walls 4, 5, which can be folded down.

Figure 2:
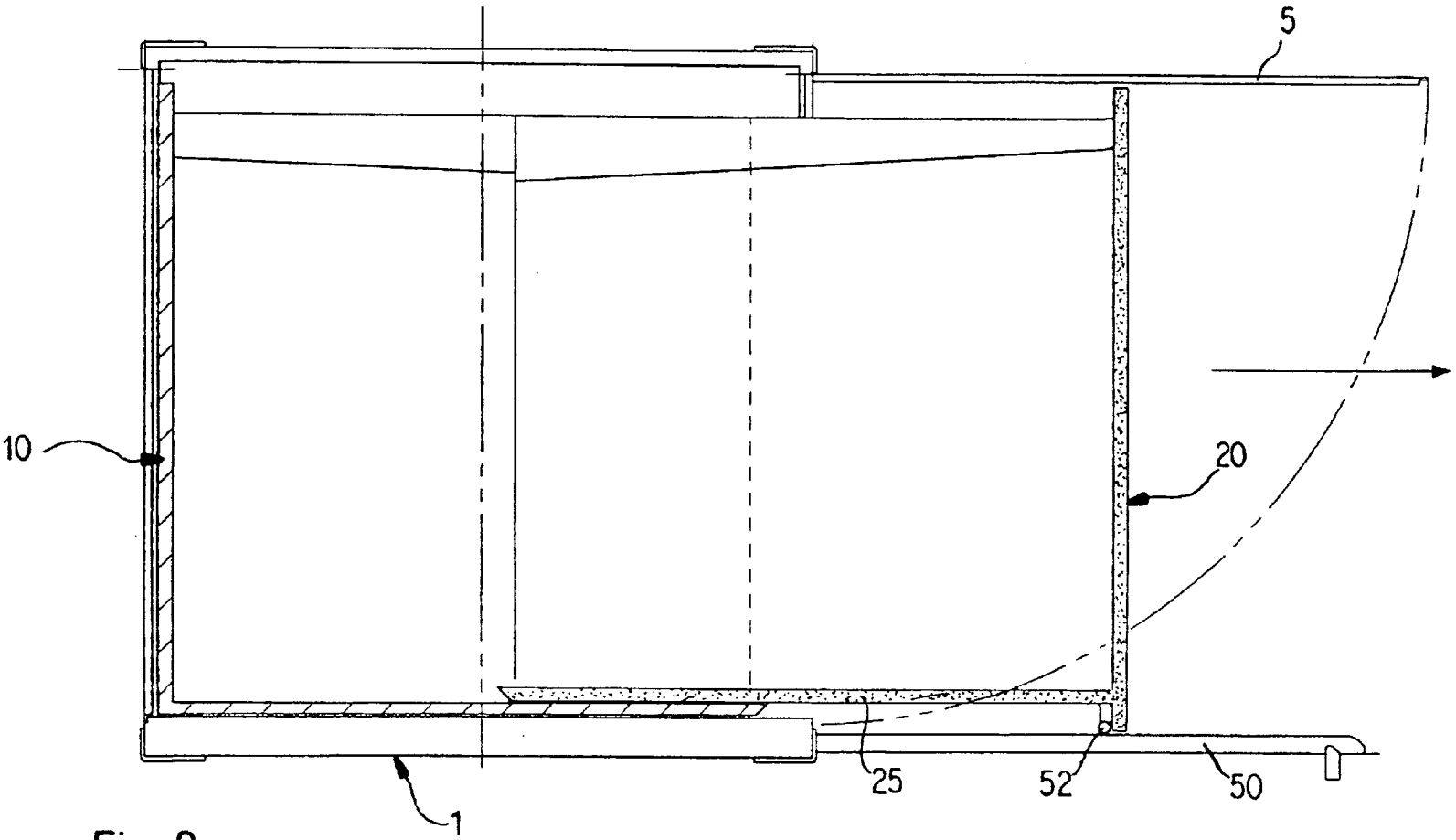
FIG. 2 is a vertical sectional view of an inventive container with a first expansion element that is partially moved out.

In FIG. 2 the smaller expansion element 20 has already been partially moved out. Before the expansion element is moved out, the side wall 5 of the basic container 1 is swung away toward the top. To move the expansion element out, guide rails 50 (typically two guide rails per expansion element) are installed. They in turn can be slid out of the basic container. The expansion element 20 is moved by means of rollers 52, which roll down over the guide rails 50. The length of the base, on whose underside the rollers 52 are mounted, is dimensioned in such a manner that during the moving out operation the bottom wall 25 of the expansion element remains in the horizontal position.

Figure 3:
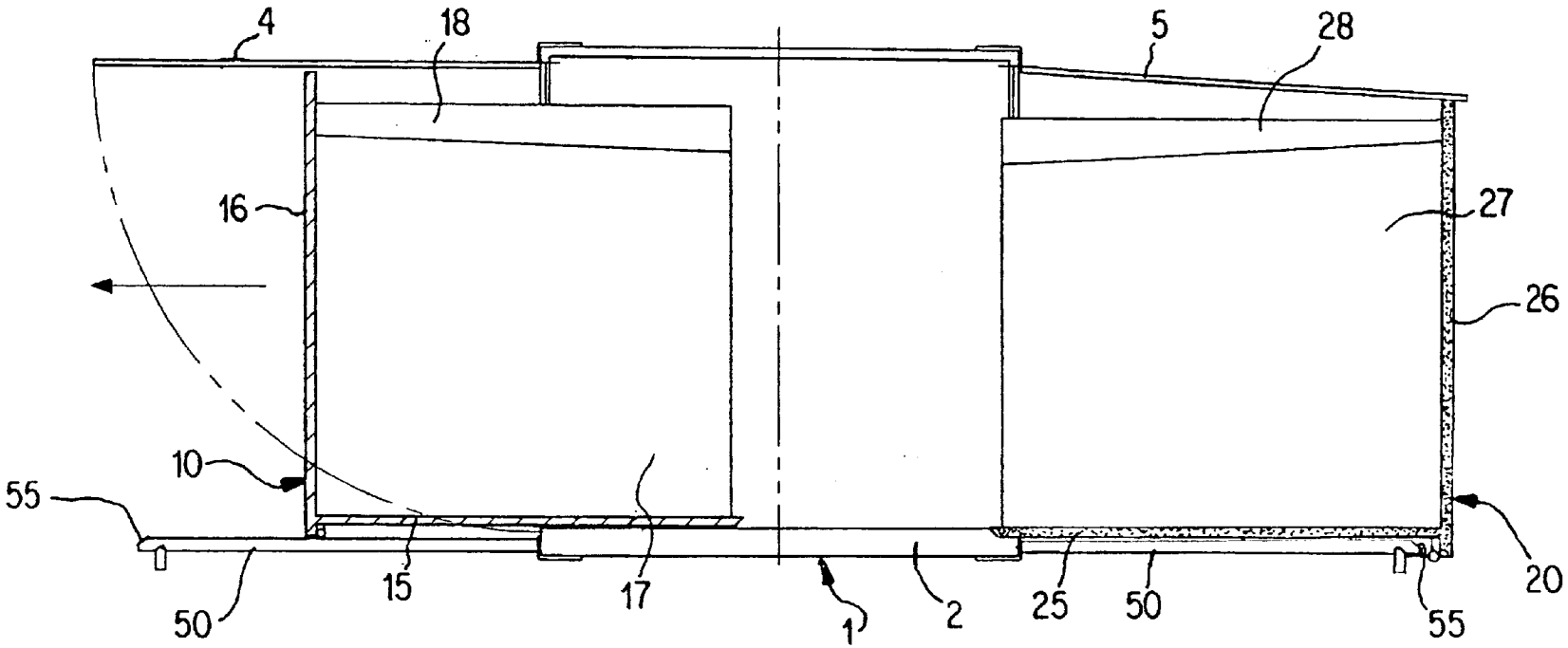
FIG. 3 is a vertical sectional view of an inventive container with the expansion element fully moved out and lowered as well as with the second expansion element that is partially moved out.

In FIG. 3 the smaller expansion element 20 has already been completely moved out and then, upon reaching the end area of the guide rails 50, lowered so that at this stage the bottom wall 25 of the expansion element 20 is at the same height as the bottom wall 2 of the basic container 1. The device for lowering the expansion element 20 is disposed and acts preferably between the expansion element 10 and the basic container 1. In the depicted embodiment there are slanting steps 55, which descend outwardly on the exterior end of the guide rail 50 and which are intended for lowering. There are also corresponding slanting steps on the edge of the bottom wall 2 of the basic container 1. This edge faces the expansion element 20. The larger expansion element 10 is moved out and lowered analogously. Since during the moving out operation this expansion element 10 rests directly on the bottom wall 2 of the basic container 1, it is lowered by a shorter distance than the smaller expansion element 20, which, during the moving out operation, rests on the bottom wall 15 of the expansion element 10.

Especially in the design with slanting steps, depicted in FIG. 3, an expansion element 10, 20 can be moved out, lowered, lifted and retracted advantageously by means of a manually operated winch, which acts between the basic container 1 and the expansion element 10, 20.

To delay the lowering movement of an expansion element 10, 20, resistance elements can be installed, for example, in the form of a spiral spring as disclosed in European Patent Document EP 0 682 156 B1 and U.S. Pat. No. 5,732,839, the disclosures of both of which are hereby incorporated by reference herein.

As an alternative to the lowering of the expansion elements by means of slanting steps 55, the guide rails can also be designed as lifting rails as disclosed, for example, in European Patent Document EP 0 760 040 B1, the disclosure of which is hereby incorporated by reference herein. To this end, the guide rails are divided into two parallel, stacked partial rails, where the one can be lifted and lowered with respect to the other partial rail, for example, by means of a hydraulic cylinder.

The guide rails 50 (designed as normal guide rails or as lifting rails) can also be disposed advantageously on the side so as to be offset in relation to the expansion elements 10, 20, instead of below the expansion elements 10, 20. This feature has its advantages, especially when diagonal braces are disposed (parallel to the side walls) for stabilizing the side walls of the expansion elements that are moved out. Since the diagonal brace and the guide rail can then lie in the same plane, the bracing moments can be introduced into the container roof without misalignment moment. Thus, there is no need for an otherwise necessary cross brace between the parallel guide rails, a feature that results ultimately in a reduction in the assembly time of the container.

Figure 4:
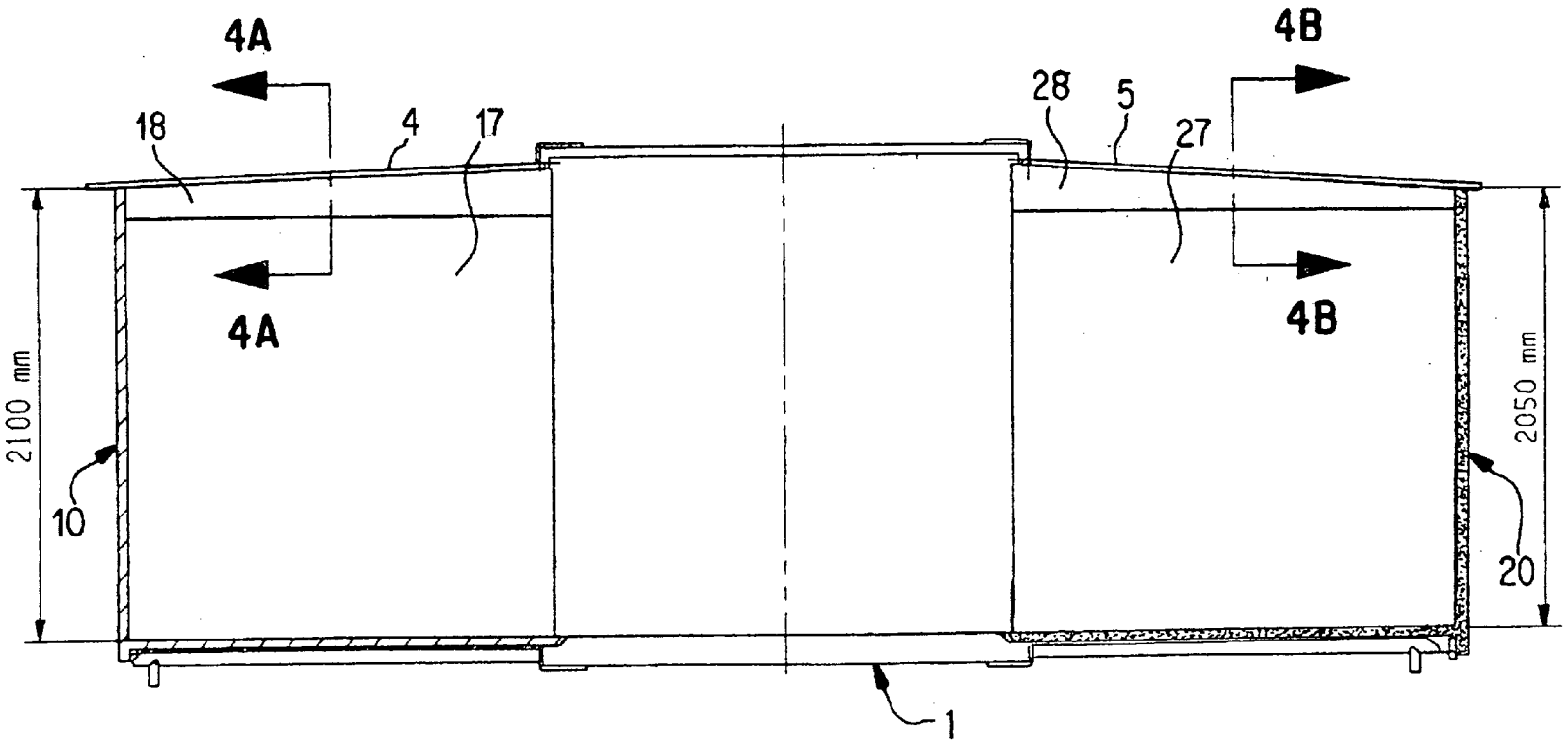
FIG. 4 is a vertical sectional view of an inventive container with the expansion elements fully moved out and lowered.

FIG. 4 shows the situation, in which the two expansion elements 10, 20 are fully moved out and lowered. The drawing shows exemplary dimensions for the minimum standing height in the two expansion elements. When the two expansion elements 10, 20 are lowered, the two hinged side walls 4, 5, forming the roof wall of the expansion elements 10, 20, come to rest slanted so as to descend outwardly. In principle the rise in the smaller expansion element 20 is somewhat larger. Thus, it is guaranteed in particular that rain water is led away from the seals at the transition point between the basic container and expansion element.

Figure 4A:
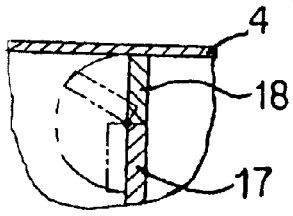
FIG. 4A is a sectional view as taken along line 4A—4A of FIG. 4.
Figure 4B:
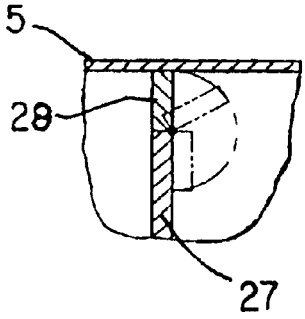
FIG. 4B is a sectional view as taken along line 4B—4B of FIG. 4.

As already evident from FIGS. 1 to 3, trapezoidal additional surface elements 18, 28 can be hinged to the upper edge of the side walls 17, 27. After the expansion elements have been completely moved out and lowered, they can be swung upwardly, as depicted in FIG. 4, so that the gap between the roof wall 4, 5 and the side wall 17, 27 is closed. The cross sectional FIGS. 4A and 4B illustrate the folding process in detail. Thus, the result is a container interior that is totally closed outwardly. Of course, the additional surface elements 18, 28 can also be transported separately from the container elements as separate modules and can be installed, as desired.

Figure 5:
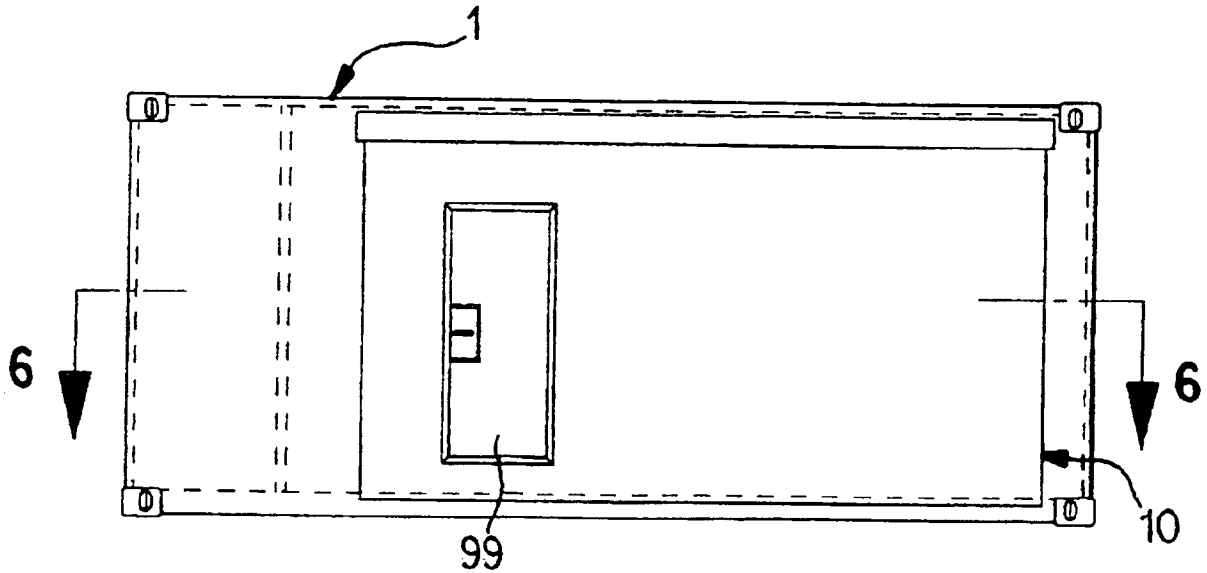
FIG. 5 is a side view of an inventive container with the expansion elements fully moved out and lowered.

FIG. 5 is a side view of a fully expanded container. One can clearly see that a door 99 is attached to the front wall of an expansion element 10.

Figure 6:
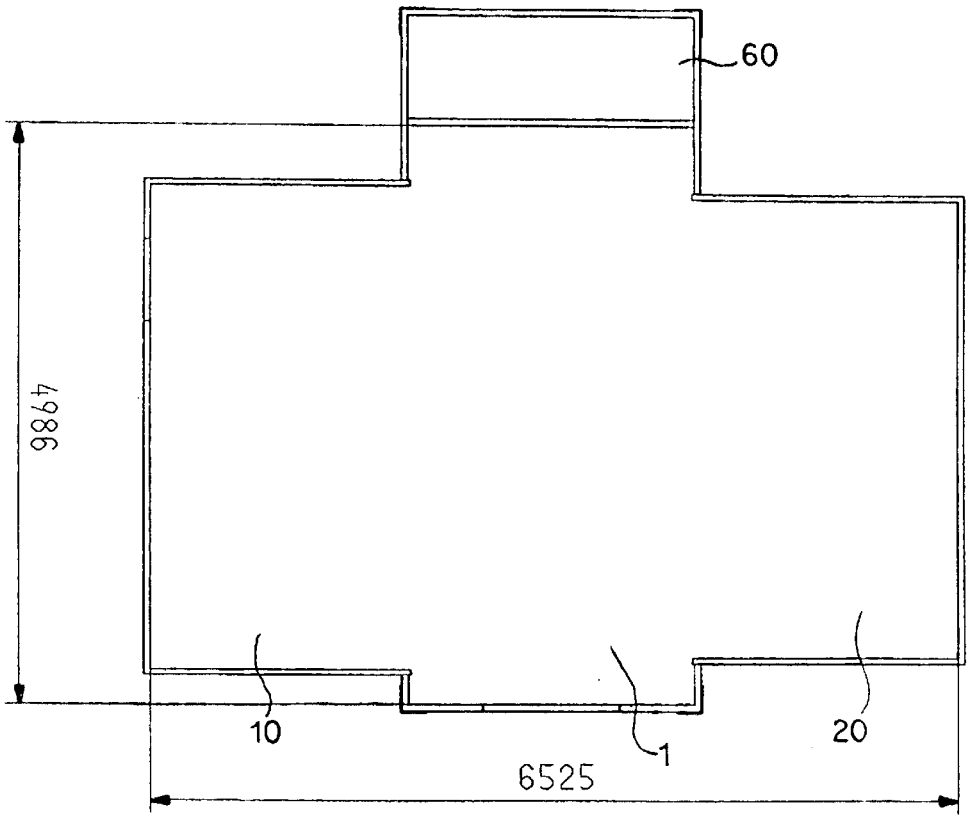
FIG. 6 is a horizontal sectional view of an inventive container with the expansion elements fully moved out and lowered as taken along line 6—6 of FIG. 5.

FIG. 6 is a horizontal sectional view along the line 6—6 of the container, according to FIG. 5, which corresponds to an outline of the container. Exemplary dimensions are given. One can recognize the basic container 1 as well as the smaller 20 and the larger 10 expansion element. In this design the basic container has an engineering room 60, in which, for example, the energy supply and the air conditioning for the work room of the container can be housed.

The examples, depicted in the drawings, show designs with precisely two expansion elements. Of course, other designs with precisely one expansion element are also possible. The procedure for moving out and lowering is carried out analogously to the procedure presented for the individual expansion elements 10, 20.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A container, in particular as a work room, with variable volume, comprising:

a basic container with a bottom wall and a roof wall, at least one expansion element, which can be non-rotatably moved out of the basic container and which exhibits a bottom wall, a side that is open in a direction of the basic container, a front wall opposite the open side, non-folding side walls at opposing ends of the front wall and arranged parallel to a direction of movement of the expansion element, and additional surface elements which, after the expansion element is in a moved-out state, close a gap above each side wall so as to totally close an interior space within the deployed expansion element from the exterior environment, wherein when the expansion element is within the basic container the expansion element bottom wall is parallel to the basic container bottom wall, and a device, with which the expansion element can be lowered in such a manner that, after the expansion element has been non-rotatably moved out of the basic container, the bottom wall of the expansion element and the basic container are at a same height, and with which the expansion element can be lifted in such a manner that, after lowering, the expansion element can be non-rotatably slid again into the basic container, wherein the basic container further has at least one hinged side wall, wherein the expansion element is open at a top, in the moved-out state a roof wall of the expansion element is formed by the side wall that is opened up on hinges and belongs to the basic container, and a height of the hinged side wall when the expansion element is in the container is substantially the same as the height of the expansion element.

2. The container, as claimed in claim 1, wherein the basic container exhibits two hinged side walls, and wherein the container exhibits two expansion elements, which can be non-rotatably moved out of the basic container in opposite directions, dimensions of the expansion elements chosen in such a manner that one expansion element can be slid into the other expansion element.

3. The container, as claimed in claim 1, wherein the additional surface elements are hinged to an upper edge of each side wall of the expansion element.

4. The container, as claimed in claim 1, wherein the front wall of the expansion element is higher than each side wall of the expansion element.

5. The container, as claimed in claim 1, wherein, when the expansion element is non-rotatably moved out and lowered, the swung-out side wall, which belongs to the basic container and which forms the roof wall of the expansion element, comes to rest so as to descend outwardly.

6. The container, as claimed in claim 1, wherein, for the expansion element there are guide rails which can be moved out of the basic container.

7. The container, as claimed in claim 6, wherein the guide rails are disposed on a side so as to be offset in relation to the expansion element.

8. The container, as claimed in claim 7, wherein the guide rails are designed as lifting rails.

9. A container, comprising:

a basic container having a bottom wall, a roof wall, and at least one hinged side wall; and at least one expansion element non-rotatably moveable with respect to the basic container between a first position within the basic container and a second position outside of the basic container, the expansion element having a bottom wall, an open side, an open top, a front wall opposed to the open side, non-folding side walls at opposing ends of the front wall and arranged parallel to a direction of movement of the expansion element, and additional surface elements rotatably disposed on an upper edge of each side wall of the expansion element which, after the expansion element is in a moved-out state, close a gap above each side wall so as to totally close an interior space within the deployed expansion element from the exterior environment, wherein when the expansion element is within the basic container the expansion element bottom wall is parallel to the basic container bottom wall;

wherein, when the hinged side wall of the basic container is rotated from a first vertical position to a second position, the hinged side wall forms a roof wall of the expansion element when the expansion element is in the second position, and a height of the hinged side wall when the expansion element is in the container is substantially the same as the height of the expansion element.

10. The container of claim 9, wherein when the hinged side wall is in the second position, the side wall slopes downwardly from the basic container.

11. The container of claim 9, wherein the basic container includes a second hinged side wall, and further comprising a second expansion element non-rotatably moveable with respect to the basic container between a first position within the basic container and a second position outside of the basic container, the second expansion element having a bottom wall, an open side, an open top, and a front wall opposed to the open side;

wherein, when the second hinged side wall of the basic container is rotated from a first vertical position to a second position, the second hinged side wall forms a roof wall of the second expansion element when the second expansion element is in the second position.

12. The container of claim 11, wherein when the first and second expansion elements are in the first position within the basic container, the first expansion element is disposed within the second expansion element.

13. The container of claim 9, wherein the front wall is higher than the side walls.

14. A method of forming a container comprising the steps of:

non-rotatably moving an expansion element from a first position internal to a basic container to a second position external to the basic container;

rotating a hinged side wall of the basic container from a first vertical position to a second position wherein the hinged side wall extends over the second expansion element and forms a roof wall of the expansion element, and rotating surface elements disposed on an upper edge of non-folding side walls of the expansion element such that a gap above each side wall is closed to totally close an interior space within the deployed expansion element from the exterior environment, wherein a height of the hinged side wall when the expansion element is in the container is substantially the same as the height of the expansion element.

15. The method of claim 14 wherein the step of non-rotatably moving the expansion element includes the step of sliding the expansion element on a guide rail.

16. The method of claim 14 further comprising the steps of:

non-rotatably moving a second expansion element from a first position internal to the basic container to a second position external to the basic container; and rotating a second hinged side wall of the basic container from a first vertical position to a second position wherein the second hinged side wall extends over the second expansion element and forms a roof wall of the second expansion element.

* * * * *